US006755224B2

(12) United States Patent
Tawa et al.

(10) Patent No.: US 6,755,224 B2
(45) Date of Patent: Jun. 29, 2004

(54) ASEPTIC FILLING APPARATUS OF THE ROTARY TYPE

(75) Inventors: Shigenori Tawa, Tokushima (JP); Tadashi Mifune, Tokushima (JP); Takao Miki, Tokushima (JP); Michio Ueda, Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 10/453,592

(22) Filed: Jun. 4, 2003

(65) Prior Publication Data

US 2003/0226616 A1 Dec. 11, 2003

(30) Foreign Application Priority Data

Jun. 7, 2002 (JP) ..... 2002-167517

(51) Int. Cl.[7] ..... B65B 1/04
(52) U.S. Cl. ..... 141/144; 141/93; 141/90
(58) Field of Search ..... 141/144–152, 141/85, 89–93; 134/169 R, 169 C, 166 C

(56) References Cited

U.S. PATENT DOCUMENTS 5,598,876 A * 2/1997 Zanini et al. ..... 141/93
6,026,867 A 2/2000 Klarl ..... 141/91
6,105,634 A * 8/2000 Liebram et al. ..... 141/91
6,481,468 B1 * 11/2002 Taggart ..... 141/85

FOREIGN PATENT DOCUMENTS

JP 03-029703 2/1991
WO WO93/04930 3/1993

OTHER PUBLICATIONS

European Search Report dated Sep. 9, 2003.

* cited by examiner

*Primary Examiner*—Steven O. Douglas
(74) *Attorney, Agent, or Firm*—Armstrong, Kratz, Quintos, Hanson & Brooks, LLP

(57) ABSTRACT

An aseptic filling apparatus of the rotary type comprises an aseptic chamber 12 provided for surrounding a path of transport of containers along with a turntable 41. An air discharge channel 71 is provided between the turntable 41 and the aseptic chamber 12. A channel control member 81 is fixedly disposed so as to cover the air discharge channel 71, and to be opposed to the turntable 41 and the aseptic chamber 12 with the channel 71 positioned therebetween. Seal clearances 101, 102 are formed between the turntable 41 and the channel control member 81, and a vent clearance 92 is provided between the aseptic chamber 12 and the channel control member 81. A collection pipe 112 is in communication with the vent clearance 92.

11 Claims, 5 Drawing Sheets

ASEPTIC FILLING APPARATUS OF THE ROTARY TYPE

BACKGROUND OF THE INVENTION

The present invention relates to an aseptic filling apparatus of the rotary type for use in filling a beverage or the like into containers in an aseptic state.

As disclosed in the publication of JP-A3-29703, conventional filling apparatus of the type mentioned include those comprising a turntable, a plurality of filling nozzles mounted on the peripheral portion of the turntable with their discharge outlets facing downward, a container support rotatable with the turntable and arranged for each of the filling nozzles for placing thereon the container to be filled, and an aseptic chamber provided for surrounding a path of transport of containers along with the turntable. An air discharge channel is provided between the turntable and the aseptic chamber and is opened to the atmosphere.

With the filling apparatus described, the aseptic chamber is held at a positive pressure with aseptic air during the steady-state filling operation, and the aseptic air is partly discharged to the atmosphere through the air discharge channel at all times.

There is no assurance that the air to be discharged through the air discharge channel will be uniform in flow rate or velocity over the entire circumference of the channel. This is attributable to the variations involved in the size of the air discharge channel in view of the working accuracy with which the turntable and the aseptic chamber are made. If variations occur in the rate of flow of the air to be discharged, the air will reversely flow into the channel, entailing the likelihood that the outside air will ingress into the aseptic chamber along with microorganisms. This impairs the aseptic nature of the aseptic chamber. The rotation of the turntable is also likely to produce turbulence in the vicinity of the air discharge channel, possibly causing the air to flow reversely into the channel.

To hold the aseptic chamber aseptic, on the other hand, there is a need to periodically sterilize the chamber with a sterilant, gas or the like, whereas the filling apparatus described permits the sterilant, gas or the like to be discharged to the atmosphere through the air discharge channel like the aseptic air. This results in the problem of causing contamination of the work environment.

SUMMARY OF THE INVENTION

An object of the present invention is to provide an aseptic filling apparatus of the rotary type wherein air can be prevented from reversely flowing into an air discharge channel and which is unlikely to give rise to the problem of causing contamination of the work environment.

The present invention provides an aseptic filling apparatus of the rotary type comprising a turntable, a plurality of filling nozzles mounted on a peripheral portion of the turntable and each having a discharge outlet directed downward, a container support rotatable with the turntable and arranged for each of the filling nozzles for placing thereon a container to be filled, and an aseptic chamber provided for surrounding a path of transport of containers along with the turntable, an air discharge channel being provided between the turntable and the aseptic chamber, the filling apparatus being characterized in that a channel control member is disposed so as to cover the air discharge channel, the channel control member being hermetically fixed to the aseptic chamber, a space between the turntable and the channel control member being sealed by seal means, a collection pipe being connected to the channel control member so as to communicate with the air discharge channel.

Thus, the aseptic filling apparatus of the invention has a channel control member so disposed as to cover the air discharge channel and hermetically fixed to the aseptic chamber, seal means sealing off a space between the turntable and the channel control member, and a collection pipe connected to the channel control member so as to communicate with the air discharge channel. Accordingly, the channel control member effectively prevents the outside air from reversely flowing into the air discharge channel. Further when sprayed into the aseptic chamber, the sterilant, gas or the like is discharged via the space between the aseptic chamber and the channel control member without the likelihood of flowing out through a space between the turntable and the control member, and is then collected by the collection pipe. This obviates the likelihood that the sterilant, gas or the like sprayed into the aseptic chamber will contaminate the work environment.

When the aseptic chamber is held at a positive pressure in its interior, with the interior of the collection pipe held at a negative pressure, the air can be prevented from reversely flowing into the air discharge channel more effectively.

When the seal means is a seal clearance provided between the turntable and the channel control member and communicating with the collection pipe, this simple means serves the function of a seal.

When the portion of the entire channel control member opposed to the turntable at least with the seal clearance formed therebetween is provided with a protective member, the protective member serves to minimize the possible trouble even if the turntable comes into contact with the channel control member.

If the air discharge channel is in the form of a labyrinth, the channel itself functions as a noncontact seal.

The seal means may alternatively be a seal member provided between the turntable and the channel control member.

The present invention provides another aseptic filling apparatus of the rotary type which comprises a closed aseptic chamber having a top wall and a circular opening in the top wall, and a turntable having an outer peripheral portion overlapping an edge portion of the top wall defining the opening for transporting containers and filling nozzles, an air discharge channel being provided between the opening-defining edge portion and the outer peripheral portion, the filling apparatus being characterized in that an annular channel control member is disposed around the turntable, a seal clearance being provided between the turntable and the channel control member, the channel control member being hermetically fixed to the aseptic chamber top wall so as to form a vent clearance between the top wall and the channel control member in communication with the air discharge channel and the seal clearance, a collection pipe communicating with the vent clearance.

Preferably, the vent clearance is greater than the seal clearance.

Preferably, the interior of the aseptic chamber is held at a positive pressure, and the interior of the collection pipe is held at a negative pressure.

Further preferably, the portion of the entire channel control member opposed to the turntable at least with the seal clearance formed therebetween is made from a material having at least one of the properties of lubricity, heat resistance and resistance to chemicals.

Further preferably, an upward annular ridge formed on an upper surface of the opening-defining edge portion of the top wall and a downward annular ridge formed beneath a lower surface of the turntable outer peripheral portion are positioned in the air discharge channel inwardly or outwardly of each other.

DESCRIPTION OF THE PREFERRED EMBODIMENT

Figure 1:
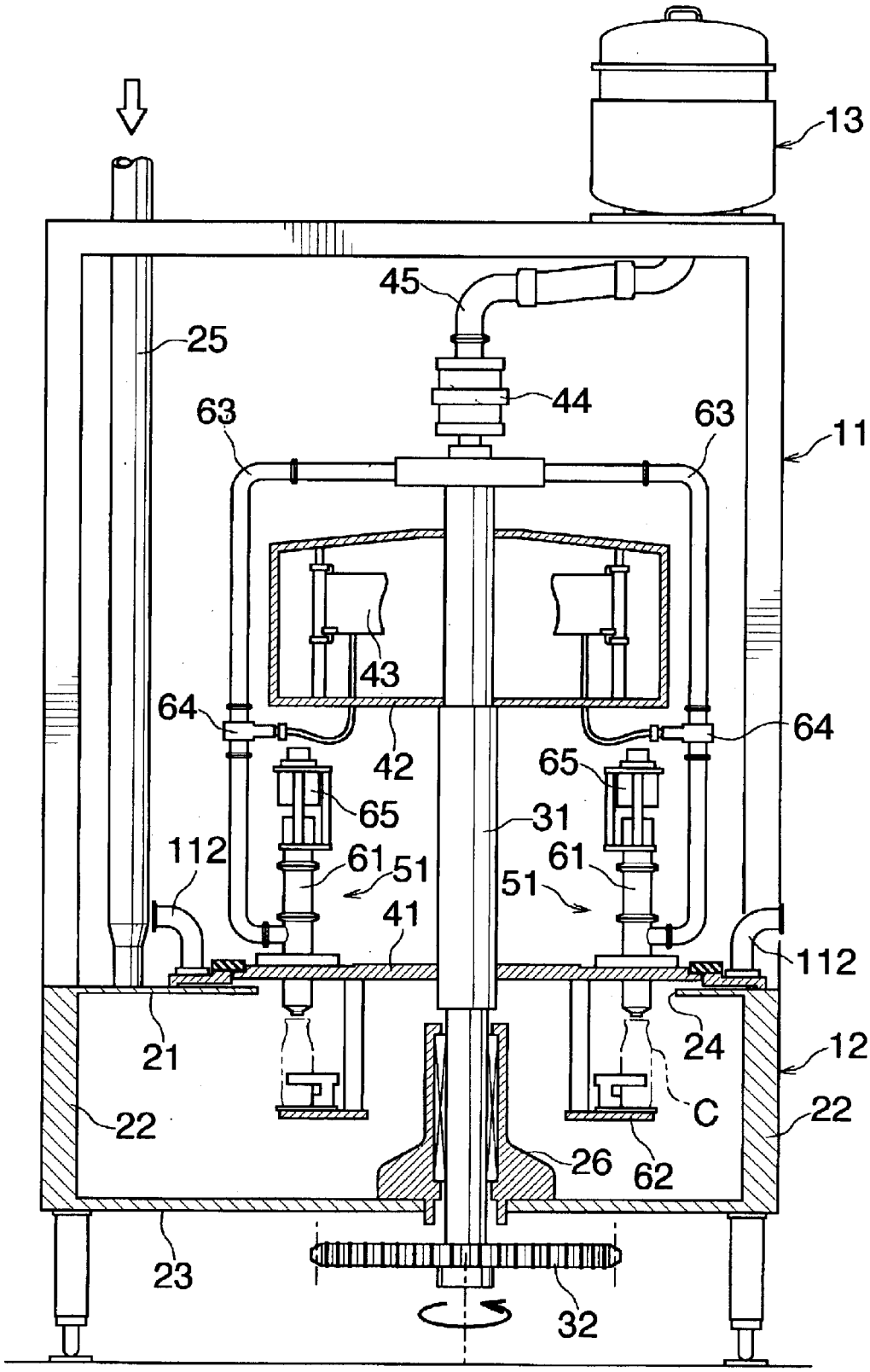
FIG. 1 is a view in vertical section of a filling apparatus according to the invention.

An embodiment of the present invention will be described below with reference to the drawings.

The illustrated filling apparatus has an apparatus body 11 of frame structure, an aseptic chamber 12 provided in a lower portion of the apparatus body 11, and a filling liquid tank 13 supported on the top of the apparatus body 11.

The aseptic chamber 12 is in the form of a rectangular to square box when seen from above and has a top wall 21, side walls 22 and a bottom wall 23. A circular opening 24 is formed in the center of the top wall 21. An aseptic air supply pipe 25 is connected to the top wall 21 at one side of the opening 24. The bottom wall 23 has a bearing 26 mounted thereon concentrically with the opening 24.

A vertical rotating shaft 31 is supported by the bearing 26. The shaft 31 vertically extends through the aseptic chamber 12 and has an upper end positioned close to the top of the apparatus body 11. The rotating shaft 31 has a lower end projecting downward and fixedly provided with a driven gear 32 in mesh with an unillustrated drive gear.

A turntable 41 in the form of a horizontal disk is fixed to the shaft 31 at an intermediate portion of its height so as to cover the opening 24. A control box 42 is fixed to an upper portion of the shaft 31. An electric device 43 is accommodated in the control box 42. A rotary joint 44 is mounted on the upper end of the shaft 31. The rotary joint 44 has a fixed side connected to the liquid tank 13 by a connector pipe 45.

A plurality of filling nozzles 51 arranged as spaced apart equidistantly are mounted on the peripheral portion of the turntable 41. Each of the filling nozzles 51 has a nozzle body 61 in the form of a vertical tube and having a discharge outlet at its lower end. The nozzle body 61 extends through the turntable 41 and has its discharge outlet positioned within the aseptic chamber 12. Each filling nozzle 51 is provided with a container support 62 positioned immediately below the discharge outlet and rotatable with the turntable 41.

The nozzle body 61 is connected by a branch pipe 63 to the rotatable side of the rotary joint 44. The branch pipe 63 is provided with a flowmeter 64 at an intermediate portion thereof. A fluid pressure cylinder 65 is mounted on the top of the nozzle body 61. The cylinder 65 is operated based on a signal from the flowmeter 64, causing a valve incorporated in the nozzle body 61 to open or close the discharge outlet.

Figure 2:
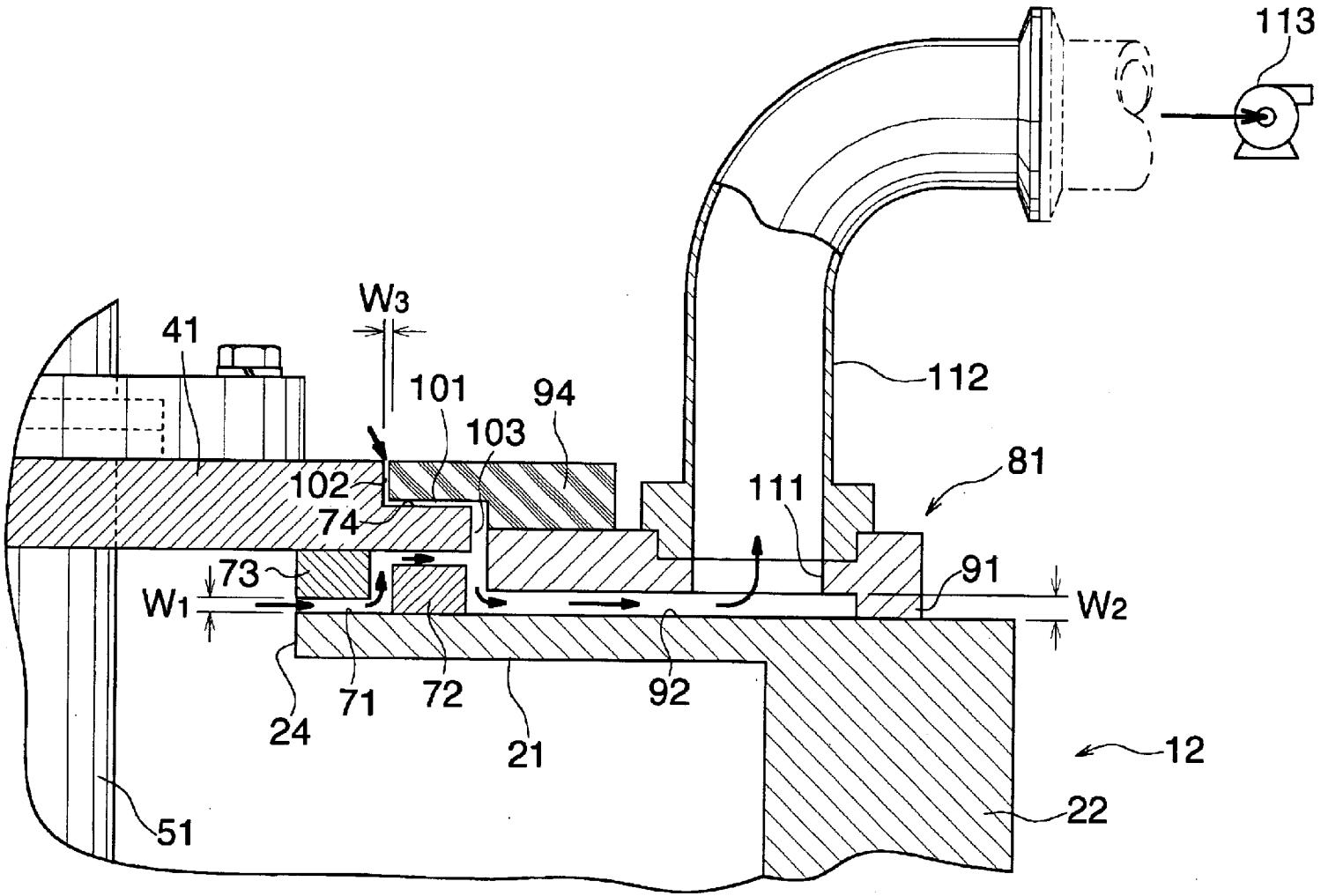
FIG. 2 is a fragmentary enlarged view in section of FIG. 1.

FIG. 2 shows in detail the filling apparatus in the vicinity of a peripheral portion of the top wall 21 of the aseptic chamber 12 around the opening 24, and in the vicinity of an outer peripheral portion of the turntable 41.

The outer peripheral portion of the turntable 41 laps over the peripheral portion around the opening 24 when seen from above. An air discharge channel 71 is formed between the upper surface of the peripheral portion around the opening 24 and the lower surface of the outer peripheral portion of the turntable 41. To provide a labyrinth passageway serving as the air discharge channel 71, the peripheral portion around the opening 24 has an annular upward outer ridge 72 formed on the upper surface thereof and the outer peripheral portion of the turntable 41 has an annular downward inner ridge 73 formed beneath the lower surface thereof.

A cutout 74 having orthogonal two surfaces is formed in the corner where the upper surface of the outer peripheral portion of the turntable 41 intersects the periphery thereof.

A channel control member 81 in the form of a horizontal annular plate is fixed to the upper surface of the peripheral portion around the opening 24.

The channel control member 81 has a spacer portion 91 formed integrally therewith and projecting downward from the outer peripheral edge of its lower surface. The spacer portion 91 provides a vent clearance 92 between the upper surface of the peripheral portion around the opening 24 and the lower surface of the channel control member 81.

A protective member 94 made from a synthetic resin in the form of a horizontal annular plate is attached to the inward portion of upper surface of the control member 91 and has its inner peripheral portion positioned in the cutout 74. The protective member 94 is satisfactory in lubricity and also has heat resistant and resistance to chemicals.

A first seal clearance 101 is provided between the bottom surface of the cutout 74 and the lower surface of the protective member 94. A second seal clearance 102 is provided between the side surface of the cutout 74 and the inner periphery of the protective member 94.

The vent clearance 92 and the first seal clearance 101 are held in communication with the air discharge channel 71 by an air gap 103. The first seal clearance 101 and the second seal clearance 102 communicate with each other and have the same dimension. The dimension W2 of the vent clearance 92 is slightly greater than the clearance W1 of the air discharge channel 71. The dimension W3 of the two seal clearances 101, 102 is much smaller than the dimension W2 of the vent clearance 92.

Vents 111 are formed in the channel control member 81 inwardly of the spacer portion 91. The vent 111 is formed in each of four locations dividing the circumference of the control member 81 into four equal portions although all the vents 111 are not shown. Each vent 111 is connected to a collection pipe 112, which is connected to a blower 113.

Figure 3:
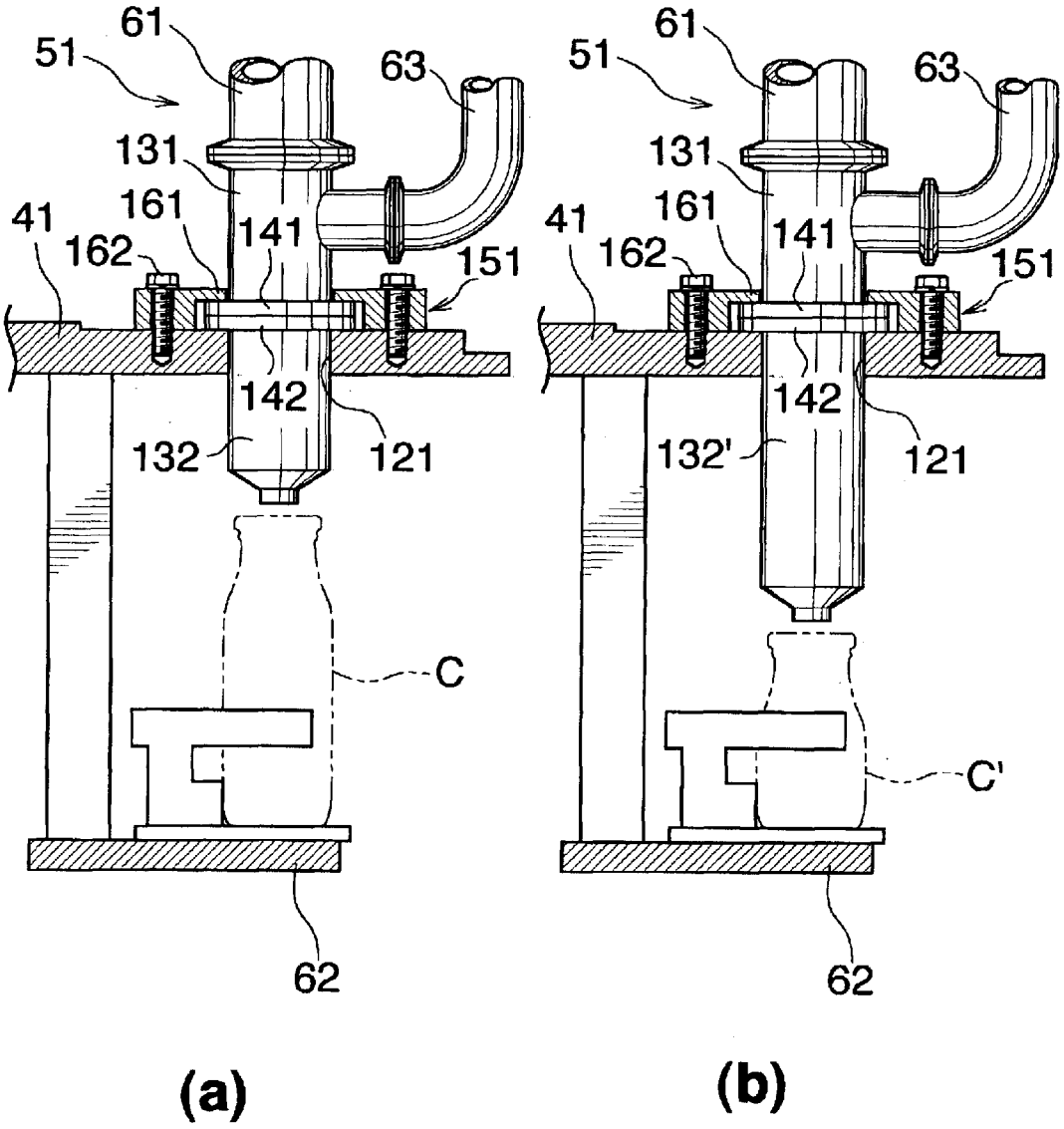
FIG. 3 includes diagrams for illustrating filling nozzles for use with containers of different heights.

FIG. 3 shows in detail the filling nozzle 51 and components of the apparatus in the vicinity of the nozzle.

The turntable 41 is provided with nozzle holes 121 each having the nozzle body 61 inserted therethrough.

The nozzle body 61 has an upper member 131 and a lower member 132. The upper member 131 has an outward upper flange 141 around the outer surface of its lower end. The lower member 132 has an outward lower flange 142 around the outer surface of its upper end. A mount ring 151 is fitted around the upper member 131. The mount ring 151 is provided at the upper end of its inner periphery with an inward flange 161 engaged with the upper flange 141 from above.

With the outward upper and lower flanges 141, 142 held by the inward flange 161, bolts 162 are inserted through the mount ring 151 and driven into the turntable 41 around the nozzle hole 121, whereby the filling nozzle 51 is mounted on the turntable 41.

As shown in FIGS. 3(*a*) and (*b*), different lower members 132, 132' are prepared which are different in length. The different kinds of lower members 132, 132' are selected for containers C, C' of different heights.

The filling nozzle 51 is mountable or demountable by attaching or removing the mount ring 151. Since this procedure can be performed from outside the aseptic chamber 12, the contamination of the aseptic chamber 12 due to the mounting or demounting the nozzle 51 can be minimized.

Figure 4:
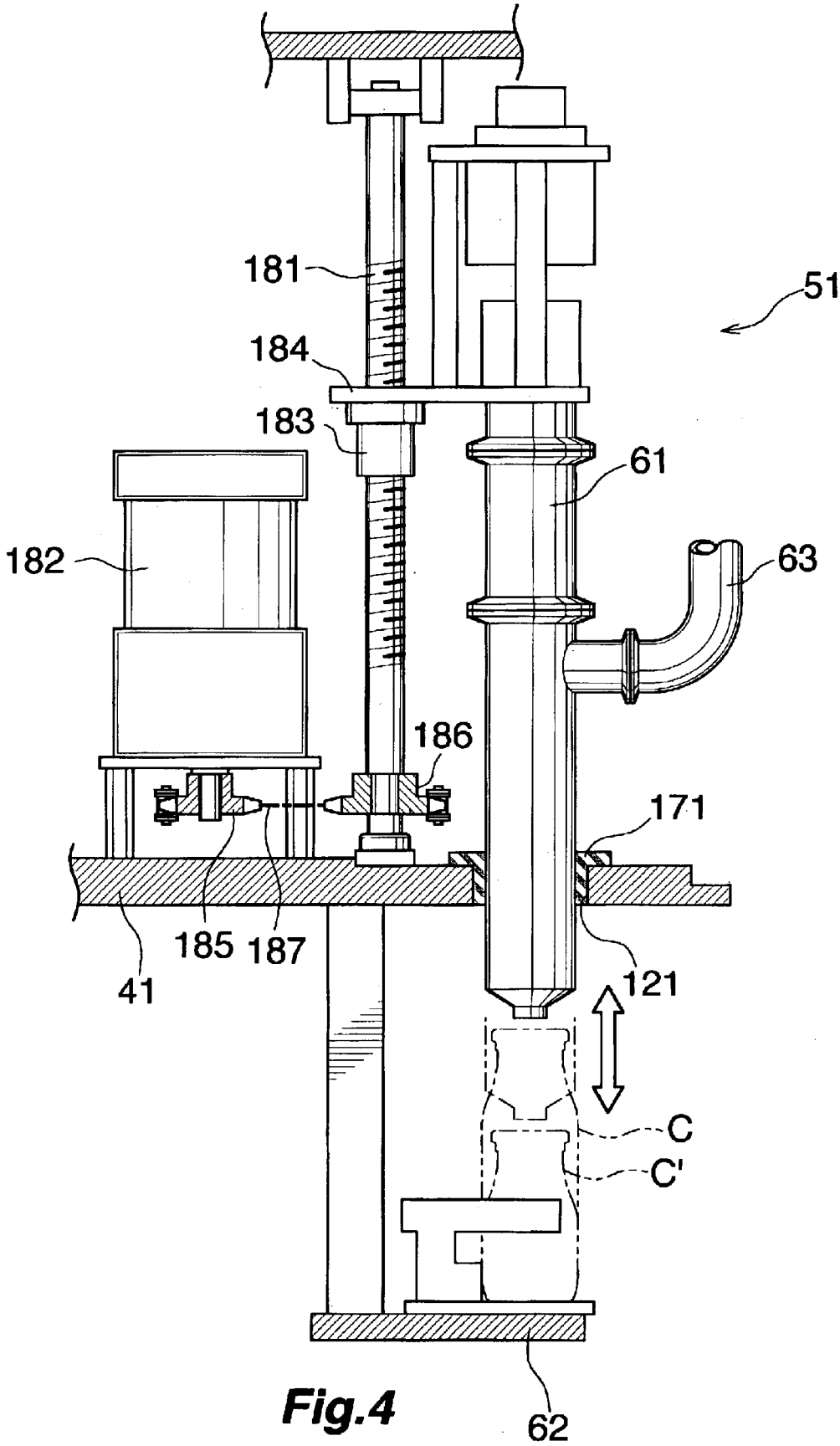
FIG. 4 is a diagram for illustrating a filling nozzle for use with containers of different heights.

FIG. 4 shows another example useful for containers C, C' of different heights. A slidable guide sleeve 171 is fitted to the turntable inner periphery defining the nozzle hole 121.

A vertical screw rod 181 is provided in parallel to the nozzle body 61 at one side thereof. Positioned at one side of the screw rod 181 is a motor 182 which is mounted as directed downward on the turntable 41. An internally threaded member 183 is screwed on the screw rod 181. A horizontal connecting bar 184 is attached to and extends between the nozzle body 61 and the threaded member 183. The motor 182 has an output shaft fixedly carrying a drive sprocket 185. A driven sprocket 186 is attached to the lower end of the screw rod 181. A chain 187 is reeved around the drive sprocket 185 and the driven sprocket 186.

When the screw rod 181 is rotated in a forward or reverse direction by the operation of the motor 182, the nozzle body 61 is moved upward or downward along with the internally threaded member 183.

With reference to FIG. 2 again, an air discharge-sealing operation of the aseptic chamber 12 will be described. The interior of the chamber 12 is held at a positive pressure with aseptic air. The vent clearance 92 has a negative pressure produced by the suction of the blower 113.

The aseptic air in the aseptic chamber 12 flows into the air discharge channel 71 and passes therethrough. The aseptic air then flows into and through the vent clearance 92 and thereafter flows into the collection pipe 112 through the vent 111. Since the vent clearance 92 has a negative pressure, atmospheric air flows into the clearance 92 through the first and second seal clearances 101, 102. The atmospheric air flowing in joins with the aseptic air flowing through the clearance 92 and is collected along with the aseptic air.

For cleaning and sterilizing the apparatus, usual air or hot air is supplied to the aseptic chamber 12 along with a sterilant in place of aseptic air. Even if oxonia or the like having pungent odor is used as an antiseptic, such an agent is wholly collected and is therefore unlikely to be released to the atmosphere.

Figure 5:
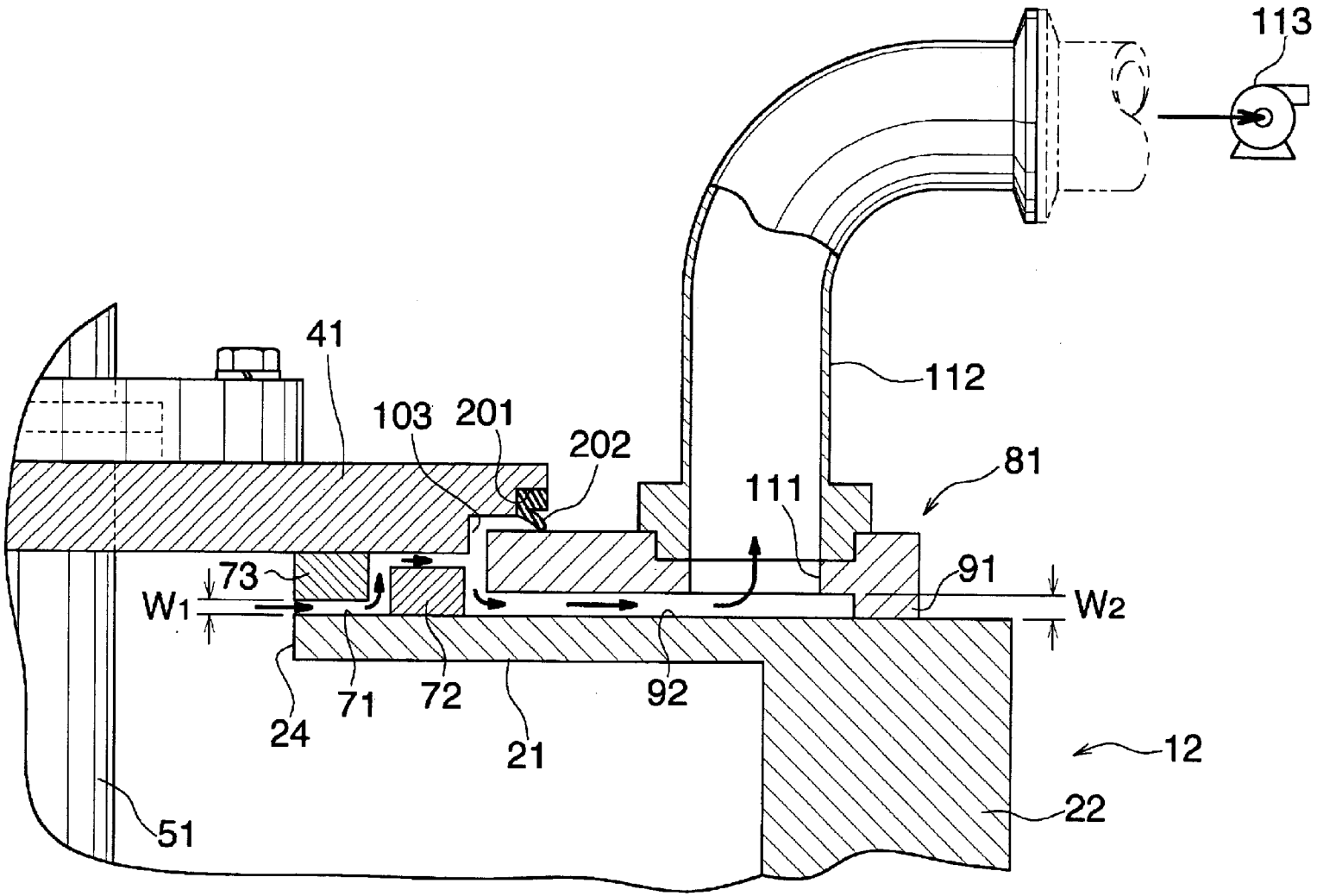
FIG. 5 is a sectional view corresponding to FIG. 2 and showing a modification of sealing means of the filling apparatus.

FIG. 5 shows an example of contact seal arrangement useful in place of the noncontact seal arrangement having the seal clearances.

The lower surface of the outer peripheral portion of the turntable 41 is opposed to the upper surface of the inner peripheral portion of the channel control member 81 in an overlapping relation when seen from above. The channel control member 81 is not provided with the protective member 94. A cutout 201 is formed in the corner of the turntable 41 where the lower surface of the outer peripheral portion thereof intersects the periphery thereof, and a seal ring 202 of elastic material is inserted in the cutout 201. The seal ring 202 has a tonguelike portion 203 having an outer end in sliding contact with the upper surface of the inner peripheral portion of the channel control member 81.

Although the filling nozzle 51 of the foregoing embodiment is adapted to measure the amount of liquid to be filled by the flowmeter 64, alternatively usable is a nozzle of such type as to measure the amount to be filled by a load cell, or of the metering piston type which is adapted to feed the liquid to be filled in a constant amount at a time.

What is claimed is:

1. An aseptic filling apparatus of the rotary type comprising a turntable, a plurality of filling nozzles mounted on a peripheral portion of the turntable and each having a discharge outlet directed downward, a container support rotatable with the turntable and arranged for each of the filling nozzles for placing thereon a container to be filled, and an aseptic chamber provided for surrounding a path of transport of containers along with the turntable, an air discharge channel being provided between the turntable and the aseptic chamber, the filling apparatus being characterized in that a channel control member is disposed so as to cover the air discharge channel, the channel control member being hermetically fixed to the aseptic chamber, a space between the turntable and the channel control member being sealed by seal means, a collection pipe being connected to the channel control member so as to communicate with the air discharge channel.

2. An aseptic filling apparatus of the rotary type according to claim 1 wherein the aseptic chamber has an interior held at a positive pressure, and the collection pipe has an interior held at a negative pressure.

3. An aseptic filling apparatus of the rotary type according to claim 1 or 2 wherein the seal means is a seal clearance provided between the turntable and the channel control member and communicating with the collection pipe.

4. An aseptic filling apparatus of the rotary type according to claim 3 wherein a portion of the entire channel control member opposed to the turntable at least with the seal clearance formed therebetween is provided with a protective member.

5. An aseptic filling apparatus of the rotary type according to claim 1 or 2 wherein the seal means is a seal member provided between the turntable and the channel control member.

6. An aseptic filling apparatus of the rotary type according to claim 1 wherein the air discharge channel is in the form of a labyrinth.

7. An aseptic filling apparatus of the rotary type comprising a closed aseptic chamber having a top wall and a circular opening in the top wall, and a turntable having an outer peripheral portion overlapping an edge portion of the top wall defining the opening for transporting containers and filling nozzles, an air discharge channel being provided between the opening-defining edge portion and the outer peripheral portion, the filling apparatus being characterized in that an annular channel control member is disposed around the turntable, a seal clearance being provided between the turntable and the channel control member, the channel control member being hermetically fixed to the aseptic chamber top wall so as to form a vent clearance between the top wall and the channel control member in communication with the air discharge channel and the seal clearance, a collection pipe communicating with the vent clearance.

8. An aseptic filling apparatus of the rotary type according to claim 7 wherein the vent clearance is greater than the seal clearance.

9. An aseptic filling apparatus of the rotary type according to claim 7 or 8 wherein the aseptic chamber has an interior held at a positive pressure, and the collection pipe has an interior held at a negative pressure.

10. An aseptic filling apparatus of the rotary type according to claim 7 wherein a portion of the entire channel control member opposed to the turntable at least with the seal clearance formed therebetween is made from a material having at least one of the properties of lubricity, heat resistance and resistance to chemicals.

11. An aseptic filling apparatus of the rotary type according to claim 7 wherein an upward annular ridge formed on an upper surface of the opening-defining edge portion of the top wall and a downward annular ridge formed beneath a lower surface of the turntable outer peripheral portion are positioned in the air discharge channel inwardly or outwardly of each other.

* * * * *